United States Patent [19]

Pachmayr et al.

[11] 4,359,833

[45] Nov. 23, 1982

[54] REINFORCED CUSHIONING GRIP FOR PISTOLS

[75] Inventors: Frank A. Pachmayr, Los Angeles; Jack R. Farrar, Whittier, both of Calif.

[73] Assignee: Pachmayr Gun Works, Inc., Los Angeles, Calif.

[21] Appl. No.: 185,759

[22] Filed: Sep. 10, 1980

[51] Int. Cl.[3] ..... F41C 23/00

[52] U.S. Cl. ..... 42/71 P

[58] Field of Search ..... 42/71 P

[56] References Cited

U.S. PATENT DOCUMENTS

| | | | |
|---|---|---|---|
| 3,672,084 | 6/1972 | Pachmayr | 42/71 P |
| 3,815,270 | 6/1974 | Pachmayr | 42/71 P |
| 4,043,066 | 8/1977 | Pachmayr et al. | 42/71 P |
| 4,132,024 | 1/1979 | Pachmayr et al. | 42/71 P |
| 4,148,149 | 4/1979 | Pachmayr et al. | 42/71 P |
| 4,199,887 | 4/1980 | Hogue | 42/71 P |
| 4,242,824 | 1/1981 | Pachmayr et al. | 42/71 P |
| 4,286,401 | 9/1981 | Pachmayr et al. | 42/71 P |
| 4,315,379 | 2/1982 | Lang | 42/71 P |

*Primary Examiner*—Charles T. Jordan

*Attorney, Agent, or Firm*—William P. Green

[57] ABSTRACT

A gun grip including two sections to be received at opposite sides of the handle of a gun, with the sections including elastomeric bodies forming two side panels having flanges projecting inwardly toward one another at the rear of the handle, and desirably also at the front of the handle, and reinforcing plates embedded within the elastomeric bodies and having edge portions projecting inwardly toward one another within the elastomeric flanges at locations behind the handle and preferably also in front of the handle.

15 Claims, 10 Drawing Figures

REINFORCED CUSHIONING GRIP FOR PISTOLS

BACKGROUND OF THE INVENTION

This invention relates to improved cushioning grips to be mounted to the handle of a pistol.

The grips of the present invention are of a general type disclosed in U.S. Pat. No. 3,672,084 issued June 27, 1972, including two grip sections receivable at opposite sides of the handle of a gun and appropriately secured to the handle. In the grip shown in that prior patent, each of the two sections is formed of a molded body of elastomeric material, desirably neoprene, containing a reinforcing plate embedded in and more rigid than the elastomeric material. These plates are desirably apertured to enhance the bond between the plates and the elastomeric material.

SUMMARY OF THE INVENTION

An object of the present invention is to provide a two section reinforced cushioned gun grip of the above discussed type in which the abutting portions of the two sections at the back of the gun handle, and desirably also at the front of the handle, meet in an optimum relation giving the composite structure formed by the two sections an essentially integrated overall appearance and configuration which remains the same over long periods of use. The outer surfaces of the two elastomeric bodies at the locations at which they meet are permanently aligned with one another to each form in effect a smooth continuation of the other surface. These two surfaces are effectively retained against dislocation or displacement relative to one another by contact with other objects in use or handling, and leave only a single neatly appearing straight line at the juncture of the two elastomeric bodies, which line is unobtrusive in appearance because of the continuous engagement of the abutting surfaces of the two elastomeric bodies and the accurate and permanent alignment of their outer surfaces with one another at the plane of contact of the two bodies.

Structurally, the elastomeric bodies form two side panels to be received at opposite sides of the gun handle and having flanges of the elastomeric material extending inwardly toward one another behind the handle of the gun, with similar flanges desirably being provided also at the front of the handle. The reinforcing plates of the two sections of the gun grip have main portions embedded within and reinforcing the side panels of the elastomeric bodies, and have edge portions which extend inwardly toward one another within the inturned flanges behind and in front of the gun handle to effectively maintain those flanges in essentially fixed orientation with respect to one another for attaining the discussed permanently aligned relationship between the outer surfaces of the flanges at locations at which they meet. The inwardly turned portions of the reinforcing plates desirably have edges which are received in close proximity to the surfaces of the elastomeric flanges which contact one another when the two sections are secured to a gun handle. At the front of the handle, the elastomeric flanges may have forward surfaces recessed to fit the fingers of a person firing the gun, with the portions of the reinforcing plates within those flanges being similarly shaped to follow the contours of the finger recesses.

BRIEF DESCRIPTION OF THE DRAWINGS

The above and other features and objects of the invention will be better understood from the following detailed description of the typical embodiment illustrated in the accompanying drawings, in which.

DESCRIPTION OF THE PREFERRED EMBODIMENT

Figure 1:
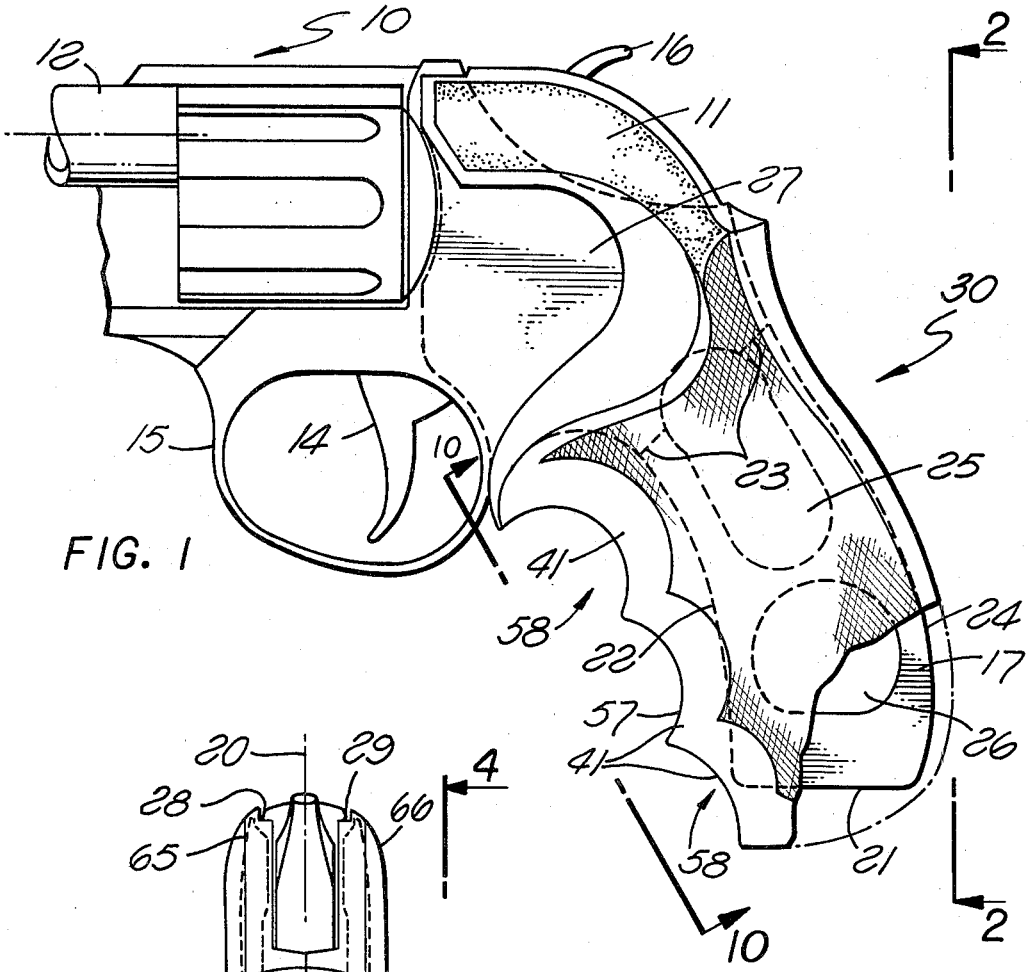
FIG. 1 is a side view of a reinforced cushioned pistol grip constructed in accordance with the invention.

The gun 10 illustrated in FIG. 1 is a conventional type of revolver having a frame 11 and a barrel 12, with a trigger 14 being received within a trigger loop portion 15 of the frame for controlling firing of a cartridge by hammer 16. The frame 11 is formed of metal and has a handle portion 17 extending downwardly and rearwardly from the frame and having the outline configuration illustrated in FIG. 1.

The handle portion 17 of the frame has parallel planar opposite side surfaces 18 and 19 extending parallel to and equidistant from a central vertical front to rear plane 20 of the gun. The bottom end of the handle is defined by a horizontal planar undersurface 21. The front surface 22 of the handle extends upwardly and then curves gradually forwardly to the location of a shoulder 23 formed by the frame. The rear surface 24 of the handle in extending upwardly from undersurface 21 may first advance gradually rearwardly and then curve forwardly as seen in FIG. 1 to the location of the shoulder 23. Openings 25 and 26 may be formed in the handle, with the upper of these openings 25 extending upwardly above and interrupting the shoulder 23. Upwardly beyond that shoulder, the frame 11 has a widened portion 27 defined by parallel vertical opposite side surfaces 28 and 29.

The gun grip 30 of the present invention is formed of two sections 31 and 32 received at opposite sides of handle portion 17 of the frame and the portion of the frame above that handle. These two sections meet in the central vertical front to rear plane 20 of the gun and are secured together by a screw 33 extending through opening 25 of the handle. Sections 31 and 32 include molded bodies 34 and 35 of elastomeric material and reinforcing plates 36 and 37 embedded therein. The bodies 34 and 35 may be formed of any appropriate resiliently deformable elastomeric material, such as neoprene rubber, desirably having a Shore hardness on the A scale of between about 35 and 55. The reinforcing plates 36 and 37 are stiffer than the deformable elastomeric material of bodies 34 and 35, and preferably are rigid. In most instances, the plates 36 and 37 are formed of a rigid metal such as steel cut and deformed to the illustrated configuration and containing apertures 38 through which the elastomeric material extends to enhance the bond between the rubber and metal.

Figures 3, 4, 5, 6, 7, 8, 9:
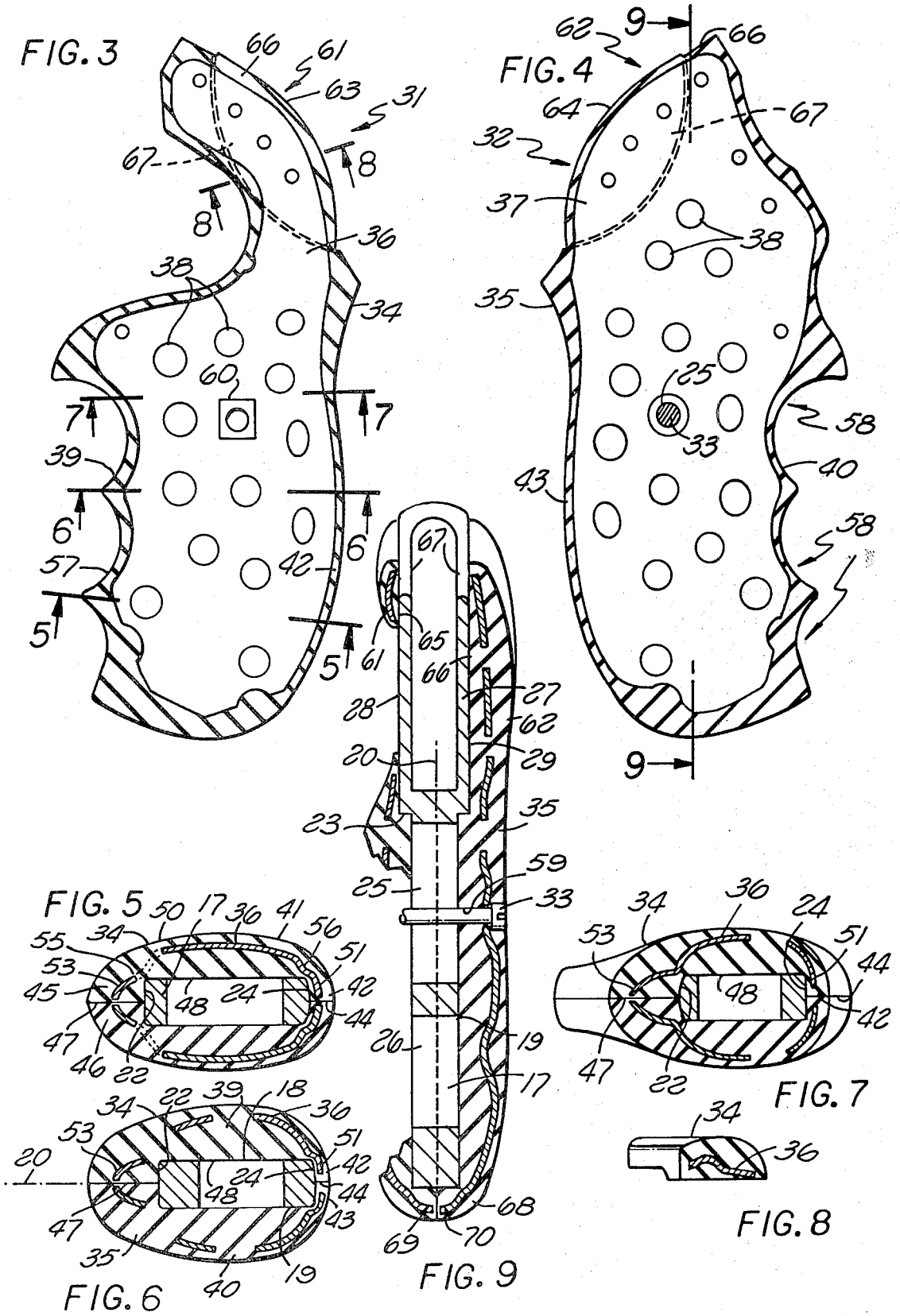
FIG. 3 is a side view of the left-hand section of the grip, with the elastomeric material broken away to reveal the configuration of the inner reinforcing plate of that section.
FIG. 4 is a view taken on line 4—4 of FIG. 2, and showing the right-hand section of the grip with its elastomeric material broken away to reveal the configuration of the reinforcing plate.
FIGS. 5, 6, 7 and 8 are sections taken on lines 5—5, 6—6, 7—7 and 8—8 respectively of FIG. 3.
FIG. 9 is a longitudinal section taken on line 9—9 of FIG. 4.

The elastomeric body of the left grip section 31 may have the external outline configuration illustrated in FIG. 1, and the contained reinforcing plate 36 as seen in FIG. 3 may have essentially the same outline configuration, but be slightly smaller so that the elastomeric material covers all of the edges of the reinforcing plate. The outline configuration of the right-hand elastomeric body 35 and its contained reinforcing plate 37 are illustrated in FIG. 4.

As seen in the sectional views of FIGS. 5, 6 and 7, the two elastomeric bodies 34 and 35 form side panels 39 and 40 extending along opposite sides of handle 17 of the gun frame, and have outer surfaces 41 engageable with a user's hand during firing of the gun. At the back of the gun handle, the two elastomeric bodies 34 and 35 have flanges 42 and 43 of the elastomeric material extending inwardly behind and in engagement with rear surface 24 of the handle and having inner planar surfaces 44 engaging one another in the central vertical front to rear plane of the gun. Similarly, at the front of the handle, the elastomeric bodies 34 and 35 have flanges 45 and 46 of the elastomeric material extending inwardly in front of and contacting the forward surface 22 of the handle, and terminating at planar surfaces 47 meeting one another in plane 20. The inner surfaces 48 of the side panels contact the outer surfaces 18 and 19 of the gun handle. At the bottom of the handle, elastomeric bodies 34 and 35 form bottom walls 68 extending inwardly beneath the handle and having planar surfaces 69 meeting in plane 20.

In the plane of FIG. 5, the two reinforcing plates 36 and 37 are mirror images of one another and follow essentially the curvature of the outer gripping surfaces 50 of the elastomeric bodies. At the back of the handle, plates 36 and 37 have portions 51 which are curved inwardly toward one another within flanges 42 and 43, and desirably approximately perpendicular to surfaces 44. These portions 51 have edges 52 which are received in close proximity to and extend essentially parallel to surfaces 44, to effectively maintain the shape of flanges 42 and 43 and hold their surfaces 44 in tight abutting engagement with one another. Similarly, at the front of the handle, plates 36 and 37 have edge portions 53 which curve inwardly toward one another within elastomeric flanges 45 and 46, and desirably generally perpendicular to abutting surfaces 47 of the two flanges. The portions 53 are thus received directly in front of handle 17, and have edges 54 which are closely proximate surfaces 47 and in the assembled condition of the parts are closely proximate one another to maintain the positional integrity and shape of the flanges and hold their abutting surfaces 47 in fixed relation and against one another. Still referring to FIG. 5, the plates 36 and 37 may be deformed at 55 and 56 as shown to provide strengthening ribs assuring adequate rigidity of the plates. At the lower end of the handle of the gun, plates 36 and 37 have portions 70 which are embedded within bottom wall portions 68 of the elastomeric bodies and extend to locations directly beneath the handle and closely proximate surfaces 69 to maintain those surfaces in tight engagement and hold the undersurfaces of walls 68 in alignment.

The sectional configurations of the elastomeric bodies and reinforcing plates in the planes of FIGS. 6 and 7 may be generally the same as in FIG. 5 and discussed above, with this same general shape continuing along the entire vertical extent of handle 17, from its lower extremity 21 to shoulder 23. The front surface 57 of the elastomeric bodies may be shaped as illustrated in FIGS. 1 and 3 to define a series of vertically spaced horizontally extending recesses 58 configured to receive the fingers of a user's hand during firing of the gun. As brought out in FIG. 3, the inwardly turned forward portions 53 of reinforcing plates 36 and 37 may be received closely proximate forward surface 57 of the elastomeric bodies, and may be shaped to follow the curvature of the forward surface 57 to reinforce and maintain the shape of the finger recesses.

Figure 2:
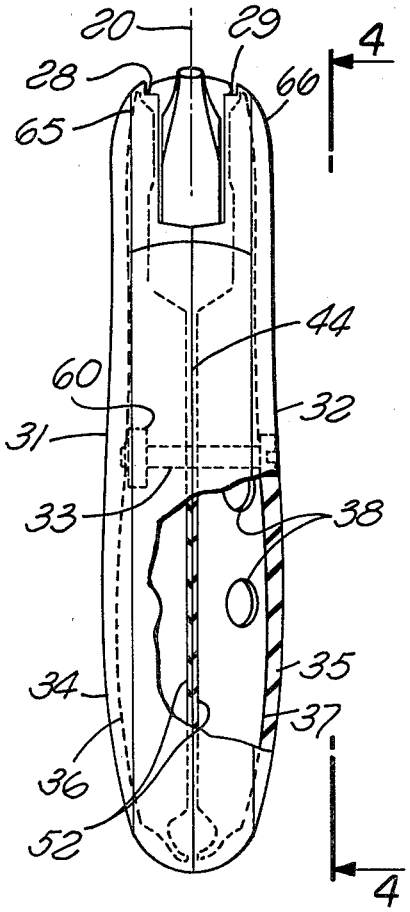
FIG. 2 is a rear view taken on line 2—2 of FIG. 1.
Figure 10:
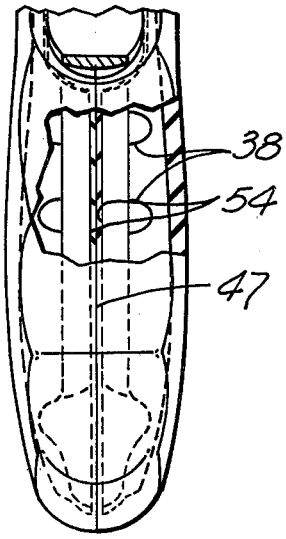
FIG. 10 is a front view taken on line 10—10 of FIG. 1.

The screw 33 for securing the two side sections together may extend through aligned openings 59 formed in the elastomeric body and the reinforcing plate of the right-hand section 32, with the head of the screw being larger than the opening in the reinforcing plate 37 to bear against that plate and tightly pull it inwardly against the right side of the gun handle. The threaded shank of the screw connects threadedly into a nut 60 which is rigidly carried by the other reinforcing plate 36, so that as the screw is tightened with respect to nut 60 it pulls the two sections toward one another and to the assembled position illustrated in FIGS. 1 and 2.

Upwardly above the level of shoulder 23, the two sections 31 and 32 of the grip are shaped differently, and have portions 61 and 62 whose elastomeric bodies 63 and 64 have inner planar parallel surfaces 65 and 66 engaging the opposite side surfaces 28 and 29 of the upper portion of the frame. At the location of the hammer 16, these upper portions of the elastomeric bodies form walls 67 which extend beyond the frame and are received at opposite sides of the hammer to shield it against contact with a user's clothing or the like. The elastomeric body 34 of the left-hand section of the grip may form an elongated forwardly curving upper portion of the configuration illustrated in FIG. 3, while the upper portion of the right-hand elastomeric body and its reinforcing plate may be of a greater area as seen in FIG. 4.

In attaching the grip to the gun illustrated in the figures, the two sections are placed against opposite sides of the handle and frame as shown, and screw 33 is connected inwardly through the right-hand section and threadedly attached to nut 60 of the left-hand section and tightened to secure the parts together. When thus retained, the two sections are rigidly held in fixed position relative to the frame of the gun and its handle portion, with the outer surfaces of the elastomeric bodies affording a high friction resiliently deformable cushioning engagement with the user's hand facilitating handling and firing of the gun. The surfaces 44 and 47 of the elastomeric flanges are held in tight abutting engagement with one another by virtue of the reinforcement of these flanges by the contained inwardly turned portions 51 and 53 of the reinforcing plates. These portions of the reinforcing plates which are in front of and behind the handle also maintain the outer surfaces of the meeting flanges in exact alignment with one another and against displacement or dislocation from such aligned condition, so that the front and rear of the handle present a smooth integrated appearance and a smooth uninterrupted surface for engaging the user's hand.

While a certain specific embodiment of the present invention has been disclosed as typical, the invention is of course not limited to this particular form, but rather is applicable broadly to all such variations as fall within the scope of the appended claims.

We claim:

1. A gun grip comprising:

two grip sections each including a body of elastomeric material and a reinforcing plate embedded in and more rigid than said elastomeric material;

said bodies of elastomeric material forming two side panels to be received at opposite sides respectively of a gun handle, two front flanges of said elastomeric material projecting inwardly toward one another from forward edges of said panels respectively at locations to be received in front of said handle, and two rear flanges of said elastomeric material projecting inwardly from rear edges of said panels and toward one another at locations to be received in back of said handle;

said reinforcing plates having main portions embedded in and reinforcing said side panels of the elastomeric material, forward portions projecting inwardly toward one another within said front flanges of the elastomeric material at locations to be received in front of said gun handle, and rear portions projecting inwardly toward one another within said rear flanges of the elastomeric material at locations to be received behind said gun handle.

2. A gun grip as recited in claim 1, in which said front and rear flanges of said two elastomeric bodies have surfaces which contact one another when said two grip sections are mounted on a gun handle.

3. A gun grip as recited in claim 1, in which said front and rear flanges of said two elastomeric bodies have surfaces which contact one another when said two grip sections are mounted on a gun handle, said front and rear portions of said reinforcing plates which are received within said flanges having edges located in close proximity to said surfaces of the flanges.

4. A gun grip as recited in claim 1, in which said front and rear flanges of said two elastomeric bodies have essentially planar surfaces which engage one another in essentially a central vertical front to rear plane of the gun handle when said two sections are mounted thereon, said front and rear portions of said reinforcing plates having edges which are received in closely proximate relation to said planar surfaces.

5. A gun grip as recited in claim 4, in which said rear portions of the reinforcing plates extend inwardly generally perpendicular to said planar surfaces of said rear flanges of the elastomeric material.

6. A gun grip as recited in claim 5, in which said forward portions of said reinforcing plates have portions extending generally perpendicular to said planar surfaces of said forward flanges.

7. A gun grip as recited in claim 6, in which said forward flanges have front surfaces forming a plurality of recesses at different vertically offset locations for receiving the fingers of a user, said forward portions of the reinforcing plates being shaped to essentially follow the contour of said finger recesses.

8. A gun grip as recited in claim 1, in which said rear flanges of the two elastomeric bodies have surfaces which engage one another when said grip sections are mounted on a gun handle, and said rear portions of the reinforcing plates extend inwardly generally perpendicular to said surfaces of said rear flanges of the elastomeric material and have edges received closely proximate said surfaces.

9. A gun grip as recited in claim 1, in which said forward flanges of the two elastomeric bodies have surfaces which engage one another when said grip sections are mounted on a gun handle, and said forward portions of said reinforcing plates have portions extending generally perpendicular to said surfaces of said forward flanges and have edges received in close proximity to those surfaces.

10. A gun grip as recited in claim 1, in which said forward flanges have front surfaces forming a plurality of recesses at different vertically offset locations for receiving the fingers of a user, said forward portions of the reinforcing plates being shaped to essentially follow the contour of said finger recesses.

11. A gun grip as recited in claim 1, including a fastener adapted to extend between said two grip sections and through said gun handle to secure the two sections together and at opposite sides of the handle.

12. A gun grip comprising:

two grip sections each including a body of elastomeric material and a reinforcing plate embedded in and more rigid than said elastomeric material;

said bodies of elastomeric material forming two side panels to be received at opposite sides respectively of a gun handle, and two rear flanges formed of said elastomeric material projecting inwardly toward one another from rear edges of said panels respectively at locations to be received in back of said handle;

said reinforcing plates having main portions embedded in and reinforcing said two side panels respectively of the elastomeric material and two rear portions projecting inwardly toward one another within said two flanges of the elastomeric material at locations to both be received behind said gun handle.

13. A gun grip as recited in claim 12, in which said rear flanges of said two elastomeric bodies have surfaces which contact one another when said two grip sections are mounted on a gun handle, and said rear portions of said reinforcing plates which are received within said flanges have edges located in close proximity to said surfaces of the flanges.

14. A gun grip as recited in claim 12, in which said rear flanges of said two elastomeric bodies have surfaces which contact one another when said two grip sections are mounted on a gun handle, and said rear portions of the reinforcing plates extend inwardly generally perpendicular to said surfaces of said rear flanges.

15. A gun grip comprising:

two grip sections each including a body of elastomeric material and a reinforcing plate embedded in and more rigid than said elastomeric material;

said bodies of elastomeric material forming two side panels to be received at opposite sides respectively of a gun handle, and two front flanges of said elastomeric material projecting inwardly toward one another from forward edges of said panels respectively at locations to be received in front of said handle, and having front surfaces containing a plurality of recesses for receiving the fingers of a user;

said reinforcing plates having main portions embedded in and reinforcing said side panels of the elastomeric material, and forward portions projecting inwardly toward one another within said front flanges of the elastomeric material at locations to be received in front of said gun handle and shaped to essentially follow the contour of said finger recesses.

* * * * *